US007983437B2

(12) United States Patent
Wong et al.

(10) Patent No.: US 7,983,437 B2
(45) Date of Patent: Jul. 19, 2011

(54) EARPHONE SET WITH DETACHABLE SPEAKERS OR SUBWOOFERS

(76) Inventors: Hammond Wong, West Covina, CA (US); Lap Shun Hui, Chino, CA (US)

( * ) Notice: Subject to any disclaimer, the term of this patent is extended or adjusted under 35 U.S.C. 154(b) by 867 days.

(21) Appl. No.: 11/969,610

(22) Filed: Jan. 4, 2008

(65) Prior Publication Data

US 2009/0175473 A1 Jul. 9, 2009

(51) Int. Cl.
*H04R 25/00* (2006.01)

(52) U.S. Cl. ..... 381/370; 381/182; 381/380; 381/381

(58) Field of Classification Search ..... 381/182, 381/326, 330, 370, 374, 379, 380, 381
See application file for complete search history.

(56) References Cited

U.S. PATENT DOCUMENTS

| | | | | | |
|---|---|---|---|---|---|
| 3,869,584 | A | | 3/1975 | Wilde | 379/430 |
| 3,900,707 | A | * | 8/1975 | Hanson | 381/370 |
| 3,984,885 | A | * | 10/1976 | Yoshimura et al. | 381/309 |
| 4,821,323 | A | * | 4/1989 | Papiernik | 381/309 |
| 4,972,468 | A | | 11/1990 | Murase et al. | 379/430 |
| 5,684,879 | A | * | 11/1997 | Verdick | 381/300 |
| D395,653 | S | | 6/1998 | Read et al. | D14/142 |
| 5,787,166 | A | | 7/1998 | Ullman | 379/430 |
| D420,007 | S | | 2/2000 | Marchall et al. | D14/226 |
| 6,356,644 | B1 | * | 3/2002 | Pollak | 381/371 |
| 6,374,126 | B1 | * | 4/2002 | MacDonald et al. | 455/569.1 |
| D464,951 | S | | 10/2002 | Skulley et al. | D14/223 |
| 6,483,925 | B1 | * | 11/2002 | Shen et al. | 381/370 |
| 6,603,863 | B1 | * | 8/2003 | Nagayoshi | 381/380 |
| 6,944,309 | B2 | * | 9/2005 | Terai et al. | 381/309 |
| D605,172 | S | * | 12/2009 | Seade | D14/205 |
| 2004/0218775 | A1 | * | 11/2004 | Huang | 381/371 |
| 2005/0244020 | A1 | | 11/2005 | Nakajima | 381/151 |
| 2007/0177748 | A1 | * | 8/2007 | Yang | 381/309 |
| 2007/0258613 | A1 | | 11/2007 | Wright | 381/374 |

* cited by examiner

*Primary Examiner* — Ramon M Barrera
(74) *Attorney, Agent, or Firm* — Walter J. Tencza, Jr.

(57) ABSTRACT

An apparatus is provided including a first speaker which emits sound, a second speaker which emits sound, and a device which connects the first speaker and the second speaker. The device may connect the first speaker or front speaker, and the second speaker or rear speaker, so that the device can be attached to an ear of a person so that the first speaker lies near the middle of the ear while the second speaker lies at a location between an ear lobe of the ear and a mastoid of a skull of the person.

15 Claims, 6 Drawing Sheets

EARPHONE SET WITH DETACHABLE SPEAKERS OR SUBWOOFERS

FIELD OF THE INVENTION

This invention relates to improved methods and apparatus concerning earphones and microphones.

BACKGROUND OF THE INVENTION

There are various devices known in the prior art for providing earphones and microphones.

SUMMARY OF THE INVENTION

One or more embodiments of the present invention provide an apparatus comprising a first speaker which emits sound, a second speaker which emits sound, and a device which connects the first speaker and the second speaker. The device may connect the first speaker or front speaker, and the second speaker or rear speaker, so that the device can be attached to an ear of a person so that the first speaker lies near the middle of the ear while the second speaker lies at a location between an ear lobe of the ear and a mastoid of a skull of the person.

In one embodiment the second speaker can be swiveled with respect to the device. The device may include a curved member which fits over the ear in order to attach the device to the ear. The second speaker may be configured so that it can be detached from the device.

The second speaker may be electrically connected to a plug which can be detached from a socket of the device in order to detach the second speaker from the device. The second speaker may be a speaker or a subwoofer. The first speaker may be located at a first end of the curved member and a second speaker may be located at a second end of the curved member. The first end may be different from the second end. An electrical cord may be provided, which runs through the curved member and is electrically connected to the first speaker and to the second speaker.

One embodiment of the present invention also includes a method including connecting a first speaker and a second speaker to a device, and attaching the device to an ear of a person so that the first speaker lies near the middle of the ear while the second speaker lies at a location between an ear lobe of the ear and a mastoid of a skull of the person.

DETAILED DESCRIPTION OF THE DRAWINGS

Figure 1:
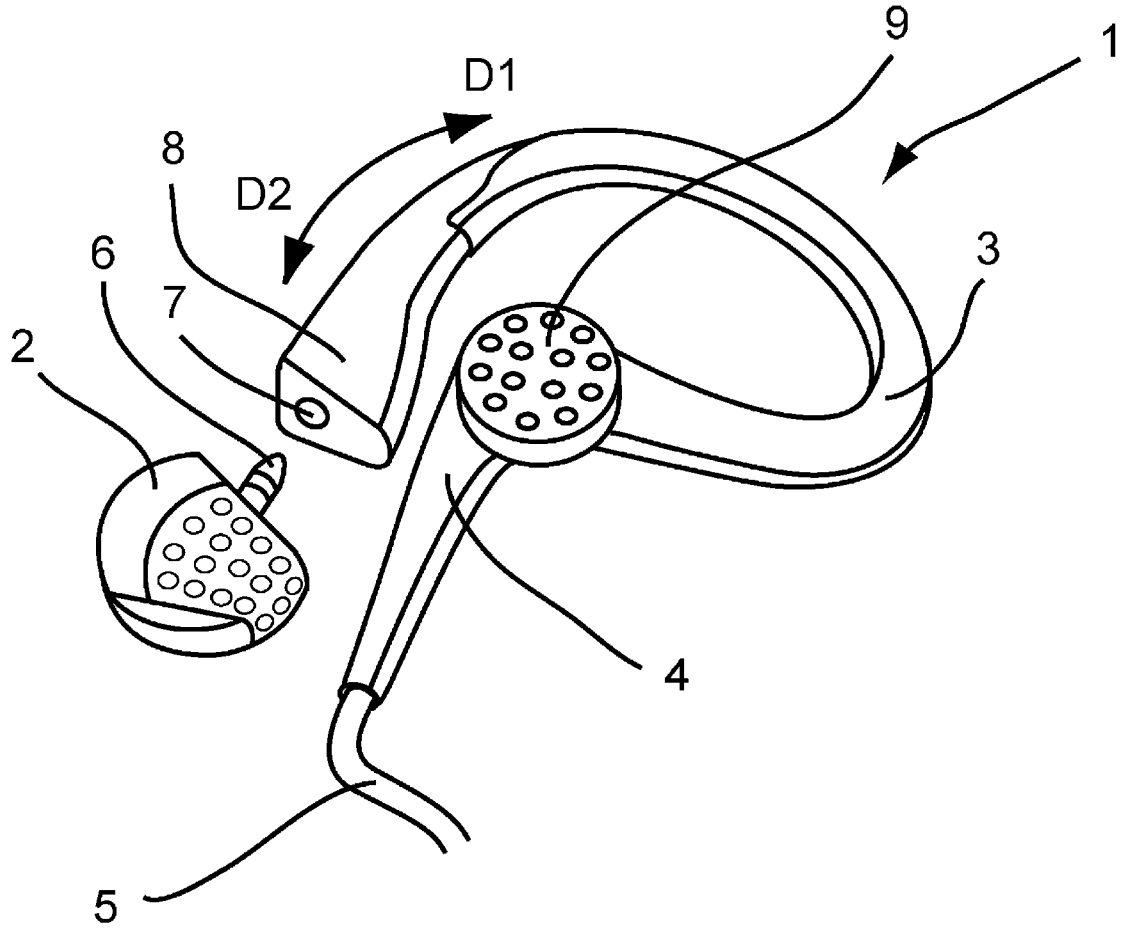
FIG. 1 shows a perspective view of an apparatus including a front speaker and a rear speaker in accordance with an embodiment of the present invention, with the rear speaker shown detached.
Figure 2:
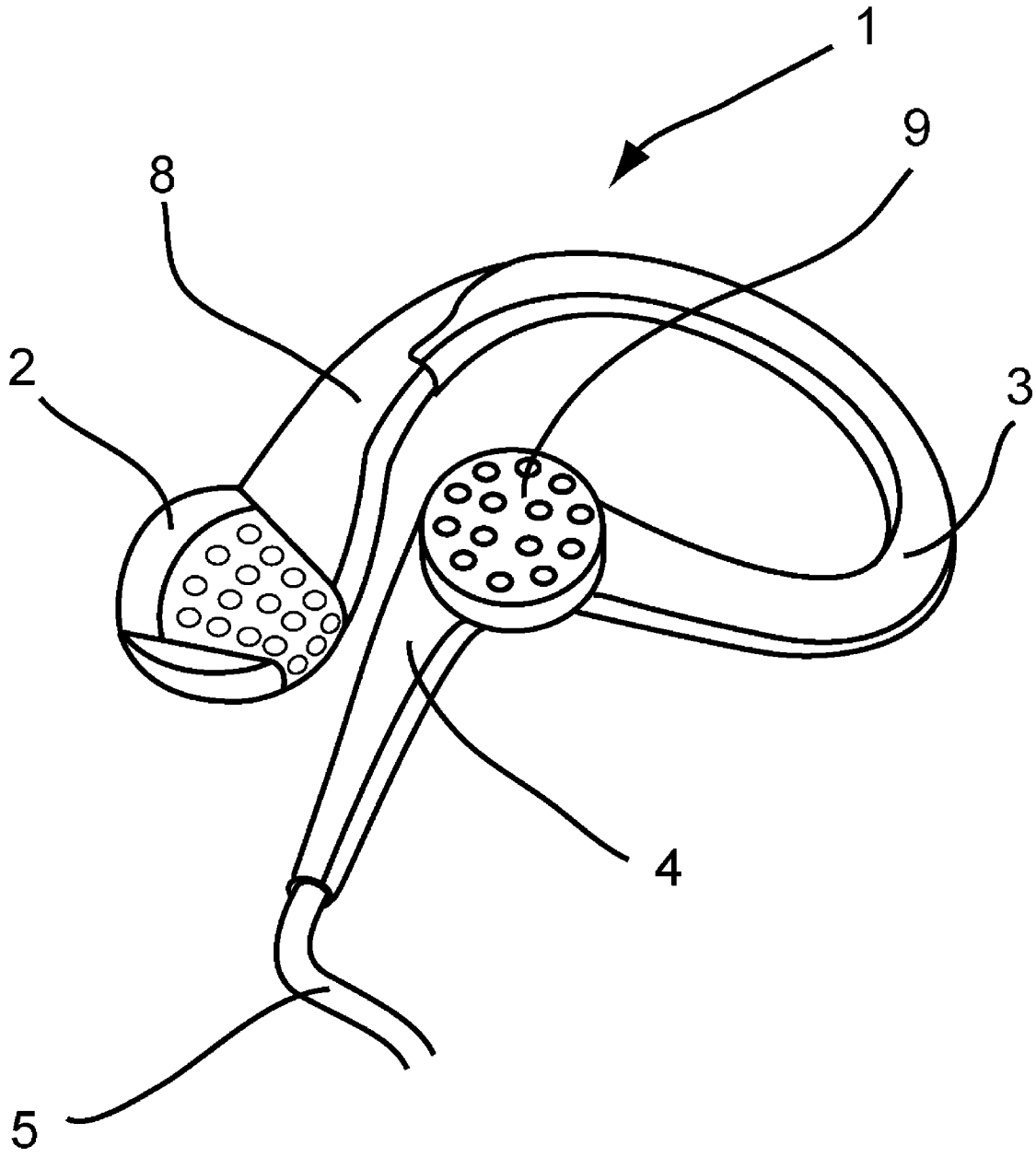
FIG. 2 shows a perspective view the apparatus of FIG. 1 with the rear speaker shown attached.

FIG. 1 shows a perspective view of an apparatus 1 in accordance with an embodiment of the present invention, with a rear speaker 2 shown detached. FIG. 2 shows a perspective view the apparatus 1 of FIG. 1 with the rear speaker 2 shown attached.

The apparatus 1 includes a rear speaker 2, a member 3, a member 4, a cord 5, a member 8, and a front speaker 9. The rear speaker 2 may be detachable from the member 8. The rear speaker 2 may include a protrusion 7 which can snap or otherwise connect with or into the opening 8. The member 8 may be connected to or may be integrated with the member 3. The member 3 may be connected to or may be integrated with the member 4. The front speaker 9 may be fixed to either the member 3 or 4 or both. The cord 5 can be an electrical cord having an insulation outer covering.

The rear speaker 2 may have a plastic housing with a speaker inside. The members 3, 4, and 8 may each have a plastic outer housing with a wire and/or conductor embedded inside the plastic housing.

FIG. 2 shows a perspective view the apparatus 1 of FIG. 1 with the rear speaker 2 shown attached, i.e. the protrusion or plug 6 has been snapped into the opening 7 of the member 8. The plug or protrusion 6 may be an electrical plug made of copper, like the one at the end of a conventional earphone. The member 8, including opening 7, may be a female receiver or socket for the plug 6. The opening 7 of the member 8 may have copper inside of it. The plug 6 may plug into the opening 7 of the member 8 so that electricity and/or an audio signal can pass from the cord 5, which may run through the members 4, 3, and 8 to the socket 7 and to the plug 6 so electricity and/or an audio signal can pass through.

Figure 3:
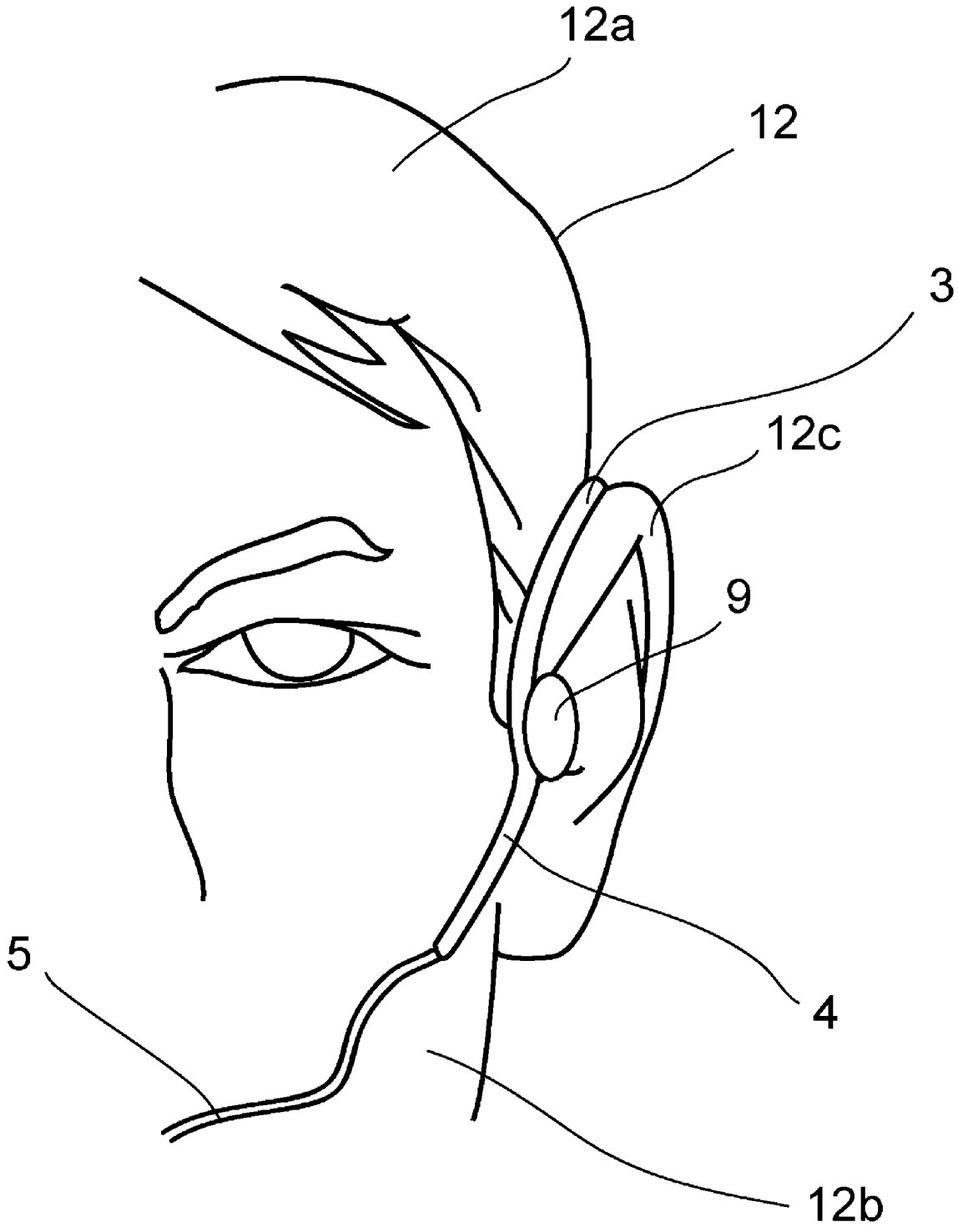
FIG. 3 shows a perspective view, from the front of a person's face, of part of the apparatus of FIG. 1 attached to the person's head.

FIG. 3 shows a perspective view, from the front of a face 12*a* of a person 12, of part of the apparatus 1 attached to a head 12*b* of the person 12. The apparatus 1 is attached to the head 12*b* so that the member 3 curves around a top part of an ear 12*c* of the person 12. In addition, as shown in FIG. 3, the front speaker 9 lies substantially centrally over the ear 12*c*, near an eardrum, not shown of the ear 12*c*. The front speaker 9 is typically plugged or inserted into an opening of the ear canal of the ear 12*c*. The member 4 lies in front of the ear 12*c*.

Figure 4:
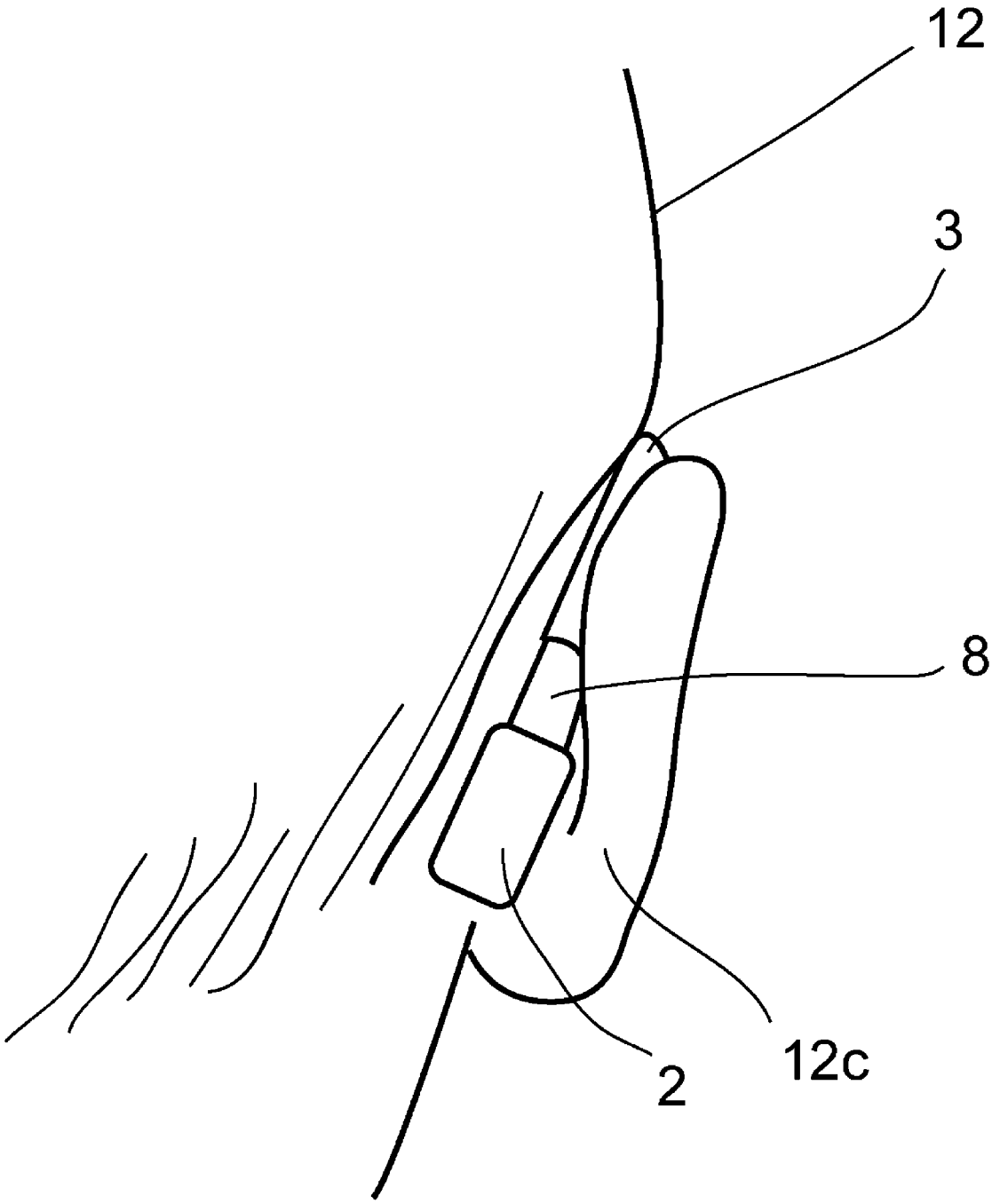
FIG. 4 shows a perspective view from the back of the person's head, of part of the apparatus of FIG. 1 attached to the person's head, with the rear speaker in a first state.

FIG. 4 shows a perspective view from the back of the person's head 12*b*, of part of the apparatus 1 of FIG. 1 attached to the person's head 12*b*. In FIG. 4, the rear speaker 2 lies in back of the ear 12*c*. This is done to create better sound effects through multiple speakers, in this case both front speaker 9 and rear speaker 2. United States Patent application, publication no. US2005/0244020 A1, which is incorporated by reference herein, explains how sound is also transmitted into the brain through a location between the lobe and the mastoid of the skull. The front speaker 9 transmits sound to the person's ear 12*c* in a conventional manner while the rear speaker 2 transmits sound through a location near the mastoid of the skull of the person, in a manner shown in U.S. Patent application publication no. US2005/0244020 A1 to inventors Yoshitaka Nakajima and Makoto Shozaka. The present invention, in one or more embodiments, combines these two effects.

Figure 5:
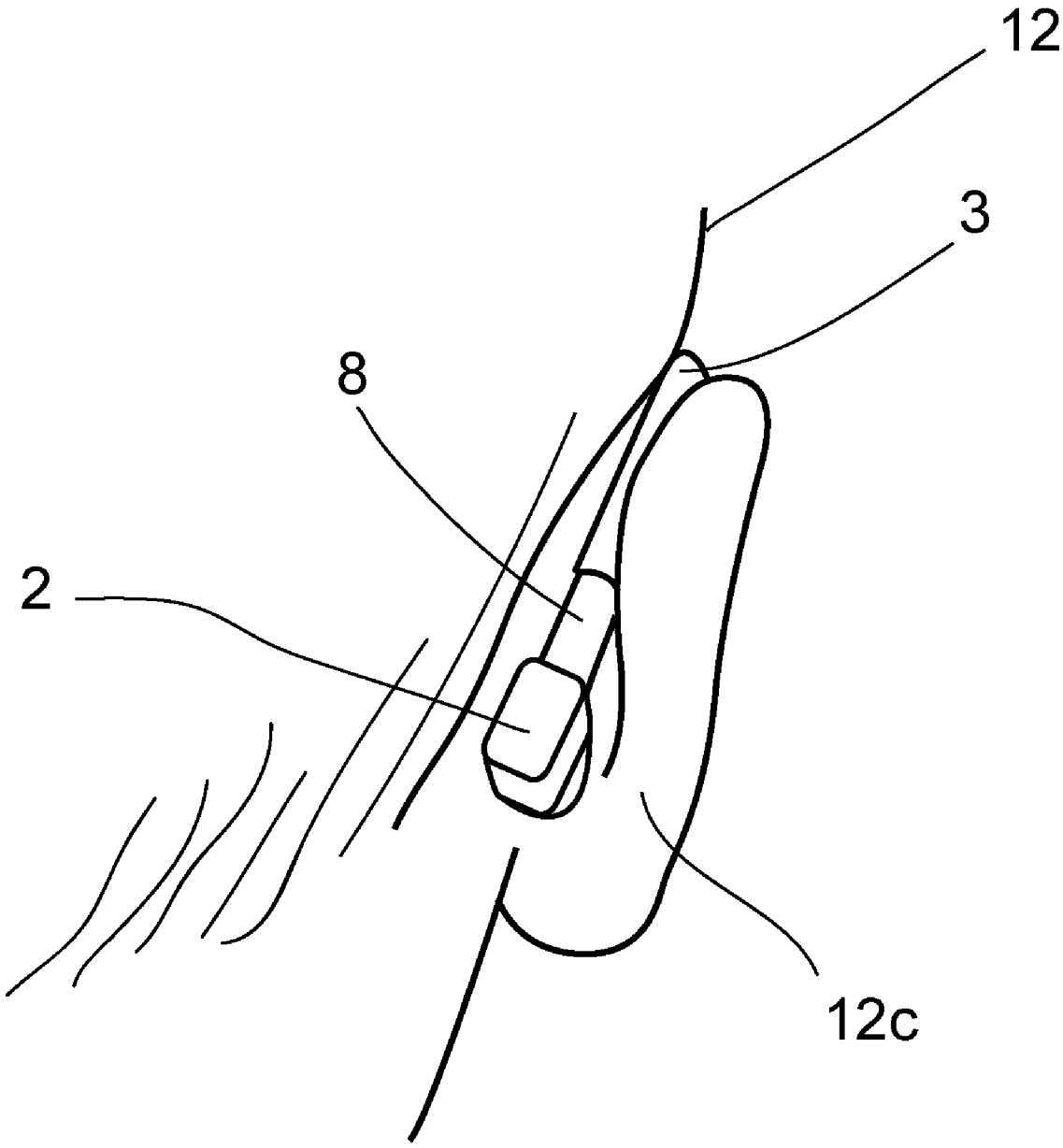
FIG. 5 shows a perspective view from the back of the person's head, of part of the apparatus of FIG. 1 attached to the person's head, with the rear speaker of the apparatus swiveled clockwise from the first state shown in FIG. 4.

The rear speaker 2 can be swiveled or rotated about the plug or protrusion 6. I.e. the plug or protrusion 6 can remain in the opening 7 while the rear speaker 2 is turned or swiveled. The swiveling is beneficial because the structure of a person's skull is different from person to person, and the audio signal reception may also be different. Users can swivel or rotate rear speaker 2 to test the best sound output from rear speaker 2 in accordance with the person's particular characteristics, needs, or desires. FIG. 5 shows a perspective view from the back of the person's head 12, of part of the apparatus 1 attached to the person's head 12, with the rear speaker 2 of the apparatus 1 swiveled clockwise from the first state shown in FIG. 4.

Figure 6:
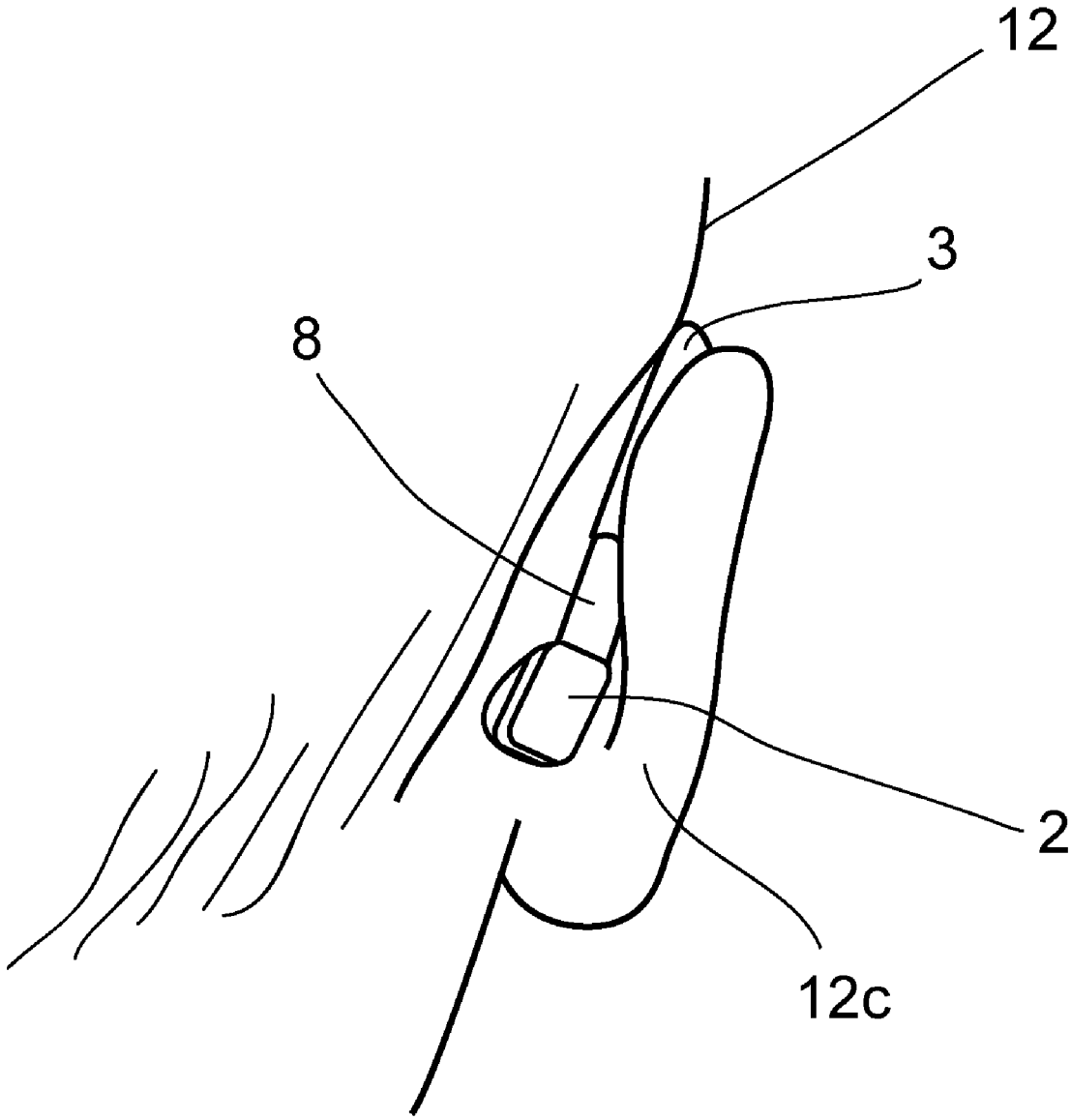
FIG. 6 shows a perspective view from the back of the person's head, of part of the apparatus of FIG. 1 attached to the person's head, with the rear speaker of the apparatus swiveled counter clockwise from the first state shown in FIG. 4.

FIG. 6 shows a perspective view from the back of the person's head 12, of part of the apparatus of FIG. 1 attached to the person's head 12, with the rear speaker 2 of the apparatus 1 swiveled counter clockwise from the first state shown in FIG. 4.

In one embodiment, the member 8 slides over the member 3 to move the member 8 in the direction D1 or in the direction D2. Moving the member 8 in the direction D2 effectively extends the combination of the member 8 and the member 3, while moving the member 8 in the direction D1 effectively shortens the combination of the member 8 and the member 3. This adjustment allows a user to adjust the location of the rear speaker 2 along the back of a person's ear, such as along the back of the ear 12*c* of the person 12 shown in FIG. 4, in order to maximize the audio input received by the rear speaker 2. This adjustment also allows a user, such as person 12, to tighten or loosen the apparatus 1 around the ear 12*c*.

The front speaker 9 is typically electrically connected to the wire of the cord 5. In at least one embodiment the rear speaker 2 is a device or speaker that receives an electrical signal from an electrical cord such as cord 5, and converts that electrical signal into sound waves, which are emitted.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

We claim:

1. An apparatus comprising:
a first speaker which emits sound;
a second speaker which emits sound;
a device which connects the first speaker and the second speaker; and
wherein the device connects the first speaker and the second speaker so that the device can be attached to an ear of a person so that the first speaker lies near the middle of the ear while the second speaker lies at a location between an ear lobe of the ear and a mastoid of a skull of the person.

2. The apparatus of claim 1 wherein
the second speaker can be swiveled with respect to the device.

3. The apparatus of claim 1 wherein
the device includes a curved member which fits over the ear in order to attach the device to the ear.

4. The apparatus of claim 1 wherein
the device includes an adjustable member which can be slid up and down the curved member to adjust the position of the second speaker.

5. The apparatus of claim 1 wherein
the second speaker is configured so that it can be detached from the device.

6. The apparatus of claim 5 wherein
the second speaker is electrically connected to a plug which can be detached from a socket of the device in order to detach the second speaker from the device.

7. The apparatus of claim 3
wherein the first speaker is located at a first end of the curved member and the second speaker is located at a second end of the curved member;
wherein the first end is different from the second end.

8. The apparatus of claim 3 further comprising
an electrical cord which runs through the curved member and is electrically connected to the first speaker and to the second speaker.

9. A method comprising:
connecting a first speaker and a second speaker to a device;
attaching the device to an ear of a person so that the first speaker lies near the middle of the ear while the second speaker lies at a location between an ear lobe of the ear and a mastoid of a skull of the person; and
wherein the first speaker emits sound; and
the second speaker emits sound.

10. The method of claim 9 further comprising
attaching the second speaker to the device so that the second speaker can swivel with respect to the device.

11. The method of claim 9 wherein
the device includes a curved member which fits over the ear in order to attach the device to the ear.

12. The method of claim 9 wherein
the second speaker is configured so that it can be detached from the device.

13. The method of claim 12 wherein
the second speaker is electrically connected to a plug which can be detached from a socket of the device in order to detach the second speaker from the device.

14. The method of claim 11
wherein the first speaker is located at a first end of the curved member and the second speaker is located at a second end of the curved member; and
wherein the first end is different from the second end.

15. The method of claim 11 further comprising
an electrical cord which runs through the curved member and is electrically connected to the first speaker and to the second speaker.

* * * * *